US007207839B1

(12) United States Patent
Shelly et al.

(10) Patent No.: US 7,207,839 B1
(45) Date of Patent: Apr. 24, 2007

(54) WRAP-AROUND FERRULE FOR COAXIAL CABLE CONNECTOR

(75) Inventors: Christopher W. Shelly, Hummelstown, PA (US); Arkady Y. Zerebilov, Lancaster, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/178,313

(22) Filed: Jul. 12, 2005

(51) Int. Cl.
*H01R 9/05* (2006.01)

(52) U.S. Cl. ..... 439/585

(58) Field of Classification Search ..... 439/585, 439/584, 582, 578, 394, 424
See application file for complete search history.

(56) References Cited

U.S. PATENT DOCUMENTS 3,728,665 A * 4/1973 Frey ..... 439/424
3,828,298 A 8/1974 Schumacher
4,010,538 A 3/1977 O'Keefe et al.
4,178,054 A 12/1979 Laudig
5,052,944 A * 10/1991 Mitani et al. ..... 439/394
5,110,308 A * 5/1992 Nishikawa et al. ..... 439/582
5,597,323 A * 1/1997 Resnick et al. ..... 439/582
6,206,727 B1 * 3/2001 Aoyama et al. ..... 439/585
6,808,417 B2 * 10/2004 Yoshida ..... 439/585
2002/0019167 A1 2/2002 Koide
2002/0088638 A1 7/2002 Nimura

* cited by examiner

*Primary Examiner*—Felix O. Figueroa
(74) *Attorney, Agent, or Firm*—Daniel R. Edelbrock

(57) ABSTRACT

A connector has a first section for receiving an inner electrical terminal, an outer electrical contact, and a dielectric member separating the inner terminal and outer contact. A second section of the connector extends at an angle from the first section and receives a conductive core and an inner insulation layer of a coaxial cable. The second section has an end for sliding between the inner insulation layer and an outer conductive sheath. The outer contact includes a ferrule for extending through an aperture in the first section and partially around an outer jacket of the cable, the conductive sheath and the second section. The ferrule has appendages for crimping on the jacket. The appendages have serrations for cutting through the jacket and electrically connecting the conductive sheath directly with the outer contact. The second section prevents the appendages and serrations from penetrating to the inner insulation layer.

18 Claims, 6 Drawing Sheets

WRAP-AROUND FERRULE FOR COAXIAL CABLE CONNECTOR

BACKGROUND OF THE INVENTION

1. Field of the Invention

This invention relates in general to terminating a coaxial cable end in an angled connector and more specifically to using parts of an electrical terminal device within and extending from the connector to mechanically and electrically connect the cable end to the connector.

2. Discussion of Related Art

The traditional ferrule used with coaxial cable connectors is a simple, loose tube. To terminate a coaxial cable, an end of the cable is stripped in three stages to expose a center conductor, inner insulation layer, and outer conductive sheath or braid. The ferrule is then assembled over the prepared coaxial cable end. Care must be taken not to damage the exposed conductors as the ferrule is slid past onto an outer jacket of the cable. The braid is flared outward and the inner insulation layer and center conductor are inserted into a tubular part of a connector. The braid is then folded around an outer surface of the tubular part and then the ferrule is slid over the braid and tubular part. Finally, the ferrule is crimped in place. This provides a good electrical and mechanical connection of the braid to the connector suitable for automotive applications. Co-pending, commonly-owned U.S. patent application Ser. No. 11/016,919, filed Dec. 21, 2004, for example, makes use of a loose ferrule of this type. However, the process is time consuming, difficult to automate and therefore expensive to use.

Another method attempts to do away with the loose-piece ferrule and a wire stripping stage. The method uses a ferrule attached to the connector body and does not require the coaxial cable outer jacket to be stripped. The ferrule has a sharp leading edge that wedges between the outer jacket and conductive braid. The jacket and ferrule are then crimped, crushing the jacket into the crimp area and compromising the electrical and mechanical performance of the crimp to a degree not acceptable for automotive use. In addition, both of these described methods traditionally require expensive screw-machining technology to fabricate the parts of the connector.

There are also terminals known in the art, such as those described in U.S. Pat. Nos. 3,828,298 and 6,206,727, having arms directly crimped on the conductive sheaths of coaxial cables. However, these terminals do not address the assembly issues involved in terminating coaxial cables in angled connectors with inner terminal devices.

SUMMARY OF THE INVENTION

Accordingly, it is an object of this invention to provide an angled connector in which the ferrule for gripping the coaxial cable is part of the terminal device within the connector, eliminating the need for a loose ferrule and the associated assembly steps.

Another object of the invention is to enable the assembly and termination of the coaxial cable in the connector to be completely automated.

A further object of the invention is to design the connector such that it can be produced in a stamping and forming process to reduce manufacturing costs.

In carrying out this invention in the illustrative embodiment thereof, a connector housing has a main section for receiving a terminal device and a barrel section extending at a right angle from the main section. The barrel section has a sharp-edged end distal from the main section. The terminal device includes an inner terminal and an outer socket or contact physically and electrically isolated from the inner terminal by a dielectric member. The inner terminal has insulation displacement blades positioned near a cable-receiving end of the main section. The outer contact has a ferrule portion arranged to extend out of an aperture in the housing and part-way around the barrel section. The ferrule portion has fingers or appendages with serrations on their inner surfaces.

The preparation of a coaxial cable end for termination in the connector housing requires only a single step. A conductive sheath and outer jacket of the cable is stripped back from an inner insulation layer and center conductive core a predetermined or specific distance. The core and inner insulation layer are inserted into the barrel section. The edge of the barrel section slides between the inner insulation layer and the conductive sheath.

The automated process for terminating and securing the cable to the connector comprises crimping the ferrule appendages around the outer jacket and conductive sheath of the cable and the barrel section. The serrations on the appendages cut through the outer jacket and contact the conductive sheath. The inner terminal is pressed toward the cable end within the main section and the insulation displacement blades cut through the inner insulation layer and contact the core of the cable.

This design does not require separate stripping of the outer jacket, pre-assembly of the ferrule onto the cable, flaring of the braid to fit over the barrel section, and folding the braid around the barrel section after the inner insulation layer and core are inserted in the barrel section. The connector housing can be manufactured using stamped and formed technology instead of the prior art screw-machined technology. The method is easily automated and significantly cheaper than the traditional manual coaxial cable braid termination methods. The typical loose piece tube ferrule and the connector body-integrated ferrule are replaced with a ferrule providing a more secure and efficient termination of the cable.

By surrounding the inner insulation layer and cable core, the barrel section eliminates any chance for penetration of conductive material into the cable inner insulation layer when the crimp is applied. Such penetration could impact the radio frequency (RF) performance or dielectric withstanding capabilities of the end product. The barrel section also prevents the cable dielectric (inner insulation layer) from being crushed when the braid is crimped. Crushing the inner insulation layer could introduce a low impedance area and adversely affect the RF performance. The mechanical strength of the termination can be maximized due to the all metal to metal crimp termination.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
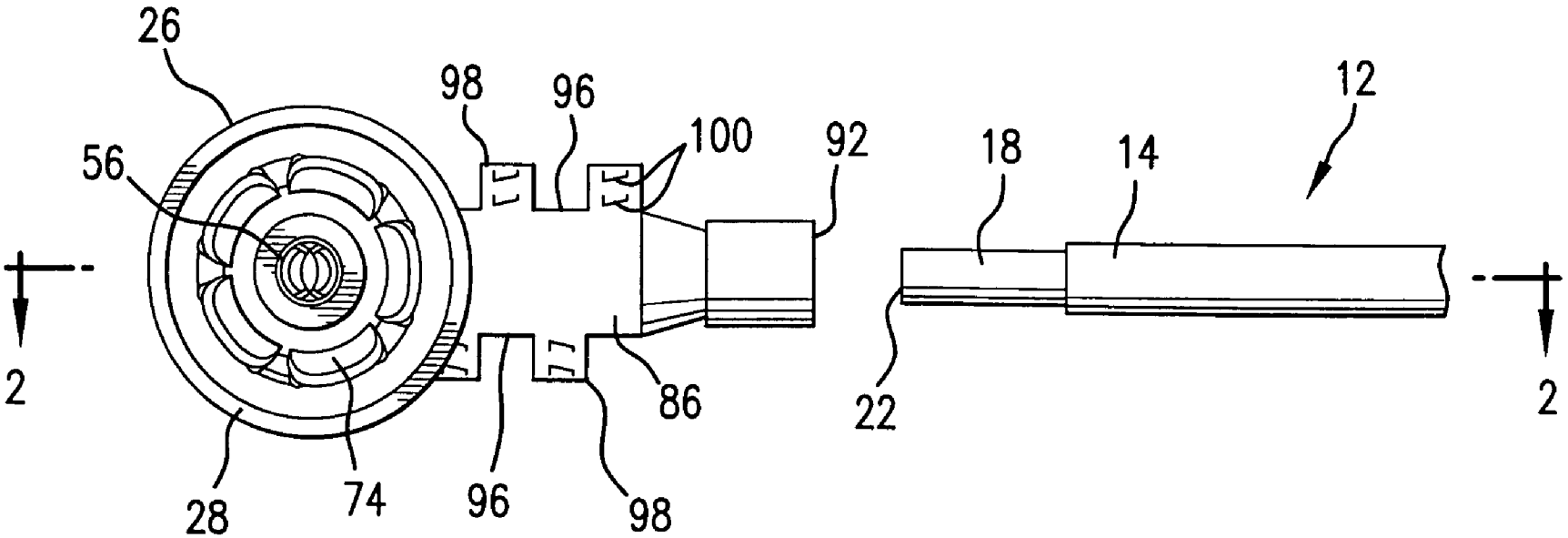
FIG. 1 is a front view of a coaxial cable connector according to the present invention in combination with, and prior to assembly with, a prepared coaxial cable end.
Figure 2:
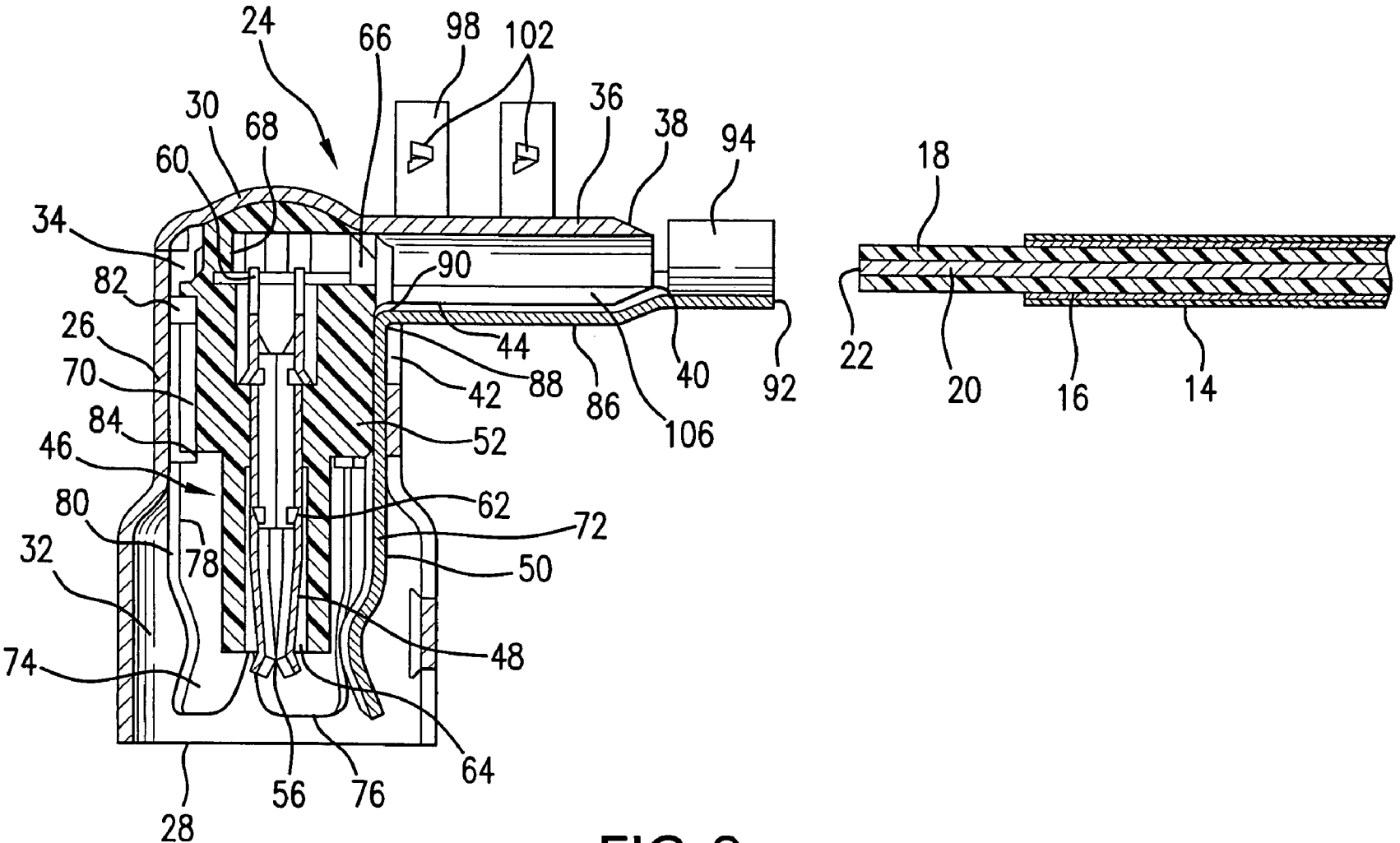
FIG. 2 is a cross-sectional side view of the connector and cable end taken along section line A—A of FIG. 1.

Referring now to FIGS. 1 and 2, a coaxial cable 12 has an outer insulative jacket 14 surrounding an electrically conductive sheath or braid 16. An inner insulation layer 18 separates the braid 16 from a center conductive core 20. The outer jacket 14 and braid 16 are stripped back from the inner insulation layer 18 a specific distance to prepare an end 22 of the cable in a single step process for termination to a coaxial cable connector body or housing 24 according to the present invention.

The connector body or housing 24 may be stamped and formed in two pieces from an electrically conductive metal or material such as zinc or a zinc-aluminum alloy. The housing 24 has a generally hollow, cylindrical, first main section 26 with a first, open terminal mating end 28 and a second, dome-shaped cable receiving end 30. The main section 26 diverges outward approximately mid-way between the ends to form two inner chambers of different diameter, a wider mating connector receiving chamber 32 adjacent the terminal mating end 28 and a narrower chamber 34 leading to the cable receiving end 30.

A second, relatively smaller, barrel section 36 extends at a right angle from the main section 26 adjacent the cable receiving end 30. The angle is illustrated as being a right angle, but could be a different angle depending on the requirements of the environment in which the connector is used. The barrel section 36 has a tapered-inward portion 38 distal from the main section 26 that forms a narrow or sharp-edged end 40. An aperture 42 in the main section 26 partially surrounds an underside 44 of the barrel section where it extends from the main section. The barrel section 36 has an inner diameter sized to receive only the inner insulation layer 18 and center conductive core 20 of the stripped cable end.

The connector includes a terminal device 46 for receipt in the main section 26 and assembly with the housing 24 and the coaxial cable end 22. The terminal device 46 comprises an inner center contact terminal 48, an outer, concentric female socket or contact 50, and a dielectric insert or member 52 sandwiched between the terminal and socket and electrically isolating them from each other.

The inner center contact terminal 48 has a first end formed as a female terminal part 56, a second end or part comprising insulation displacement surfaces or blades 60, and an intermediate part including sets of retention barbs 62 for securing the terminal 48 in the dielectric member 52. The terminal 48 is stamped or otherwise manufactured in one piece from an electrically conductive metal such as brass or stainless steel. The female terminal part 56 could alternatively be formed as a male terminal, depending on the type of terminal the connector housing 24 is meant to mate with.

The dielectric member 52 has a channel 64 of varying diameter for receiving and securing the terminal 48. The dielectric member may be made from a material such as Nylon, Teflon, polybutylene-terephalate or any of a variety of extruded plastics. It includes an opening 66 for receiving the cable end 22 and a stop surface 68 against which the cable end 22 abuts. A longitudinal guide groove 70 extends along its outer periphery. The dielectric member 52, inner center contact terminal 48, their assembly together and engagement to the cable end 22 and core 20 are described in detail in commonly-owned U.S. Pat. No. 7,070,440, herein incorporated by reference.

The outer female socket or contact 50 is constructed to accept a standard male connector (not shown) for mating with the inner center contact terminal 48. Like the terminal 48, it may be stamped and bent or otherwise manufactured in one piece from a conductive metal such as brass or stainless steel. The contact 50 has a ring element 72. Spring fingers 74 extend from the ring element 72 for receiving the male connector through a mating end 76. The ring element 72 has an inner annular surface 78 and an outer surface 80. The outer surface 80 is sized to fit snugly and securely within the chamber 34 of the housing main section 26 in a press-fit. The ring element 72 has an inner guide projection 82 for sliding along the groove 70 in the outer periphery of the dielectric member 52 when the dielectric member is inserted into the contact 50. This guides the dielectric member into the ring element 72 until it reaches an assembled position, with bent inward segments 84 of the ring element holding the dielectric member within the ring element. This assembly structure and process are also disclosed in more detail in the incorporated patent.

Figure 4:
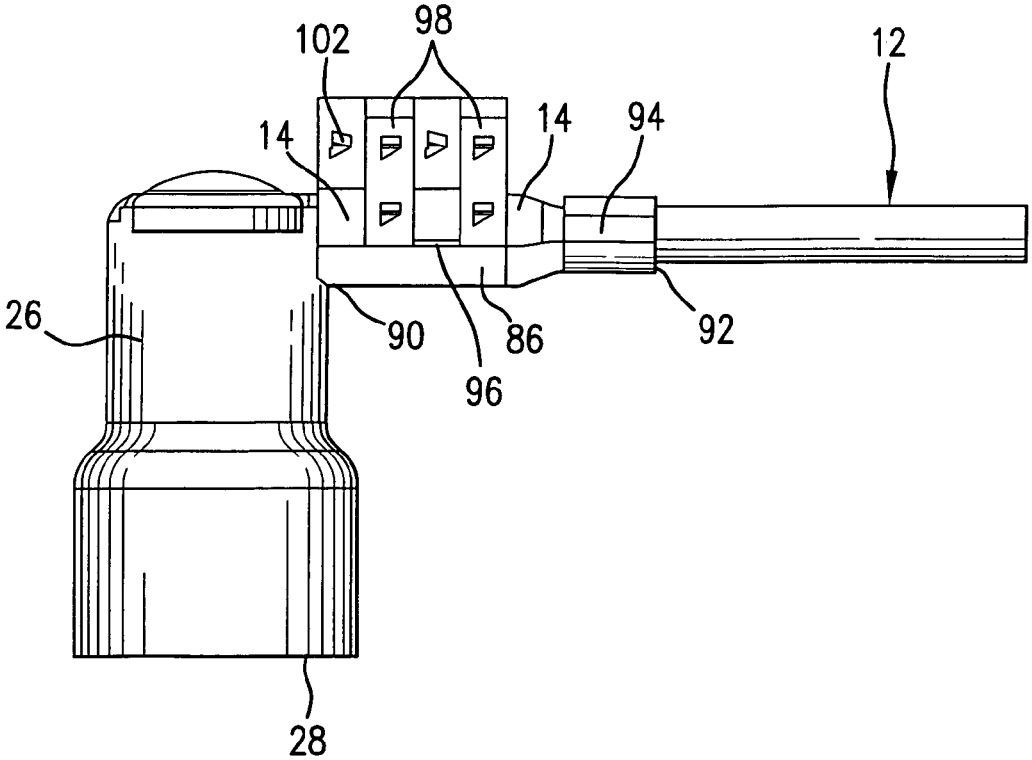
FIG. 4 is a side view of the connector with the cable end in an inserted position.
Figure 5:
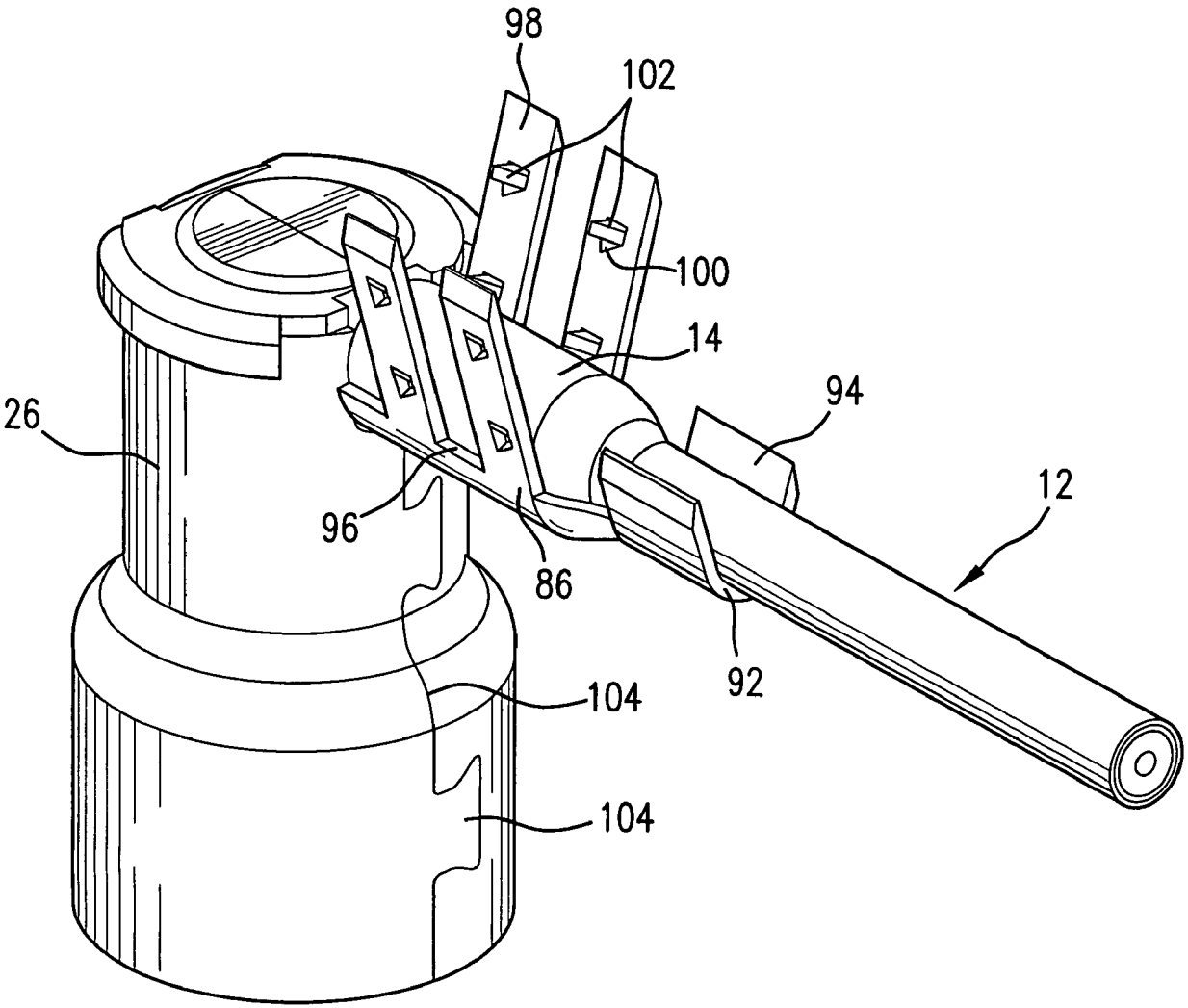
FIG. 5 is a perspective view of the connector with the cable end in the inserted position.
Figure 6:
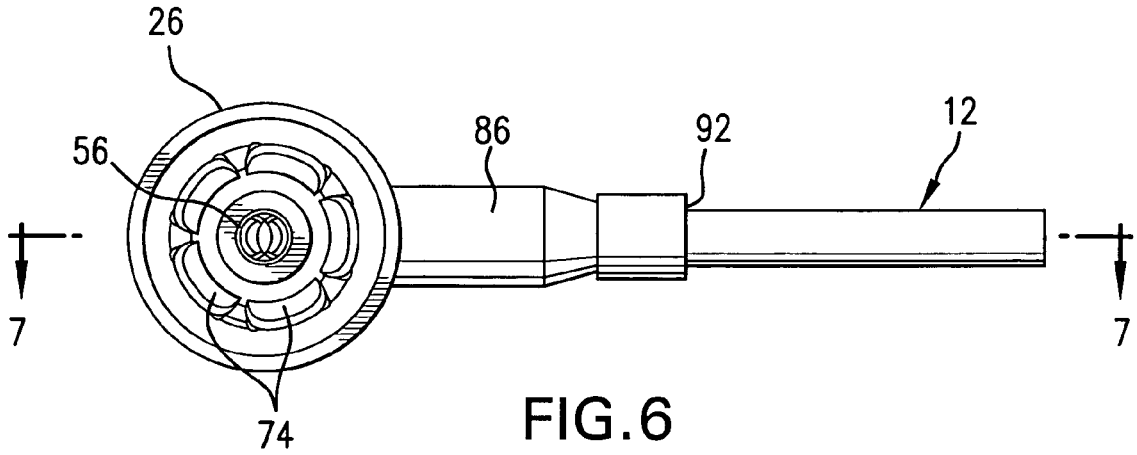
FIG. 6 is a front view of the connector with crimp appendages of the connector wrapped around the cable end to secure the cable end in the connector.
Figure 7:
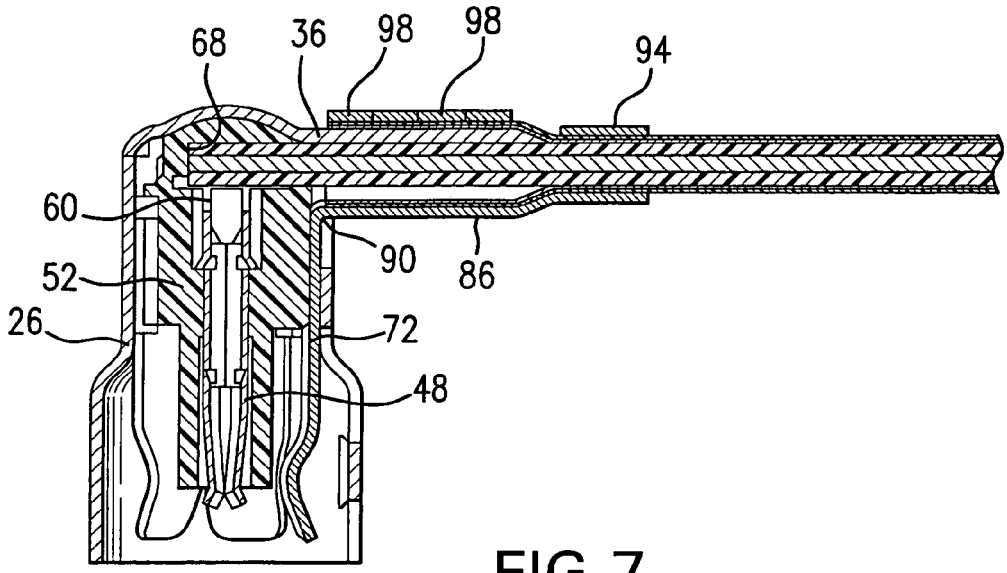
FIG. 7 is a cross-sectional side view of the connector assembly taken along section line B—B of FIG. 6.
Figure 8:
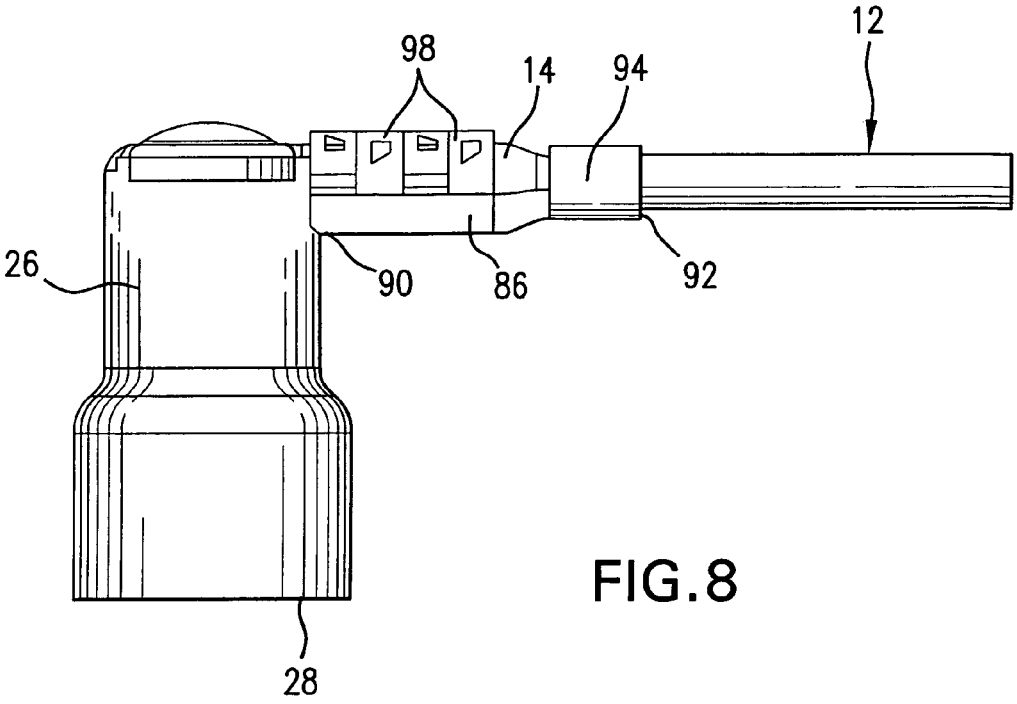
FIG. 8 is a side view of the connector and secured cable end.
Figure 9:
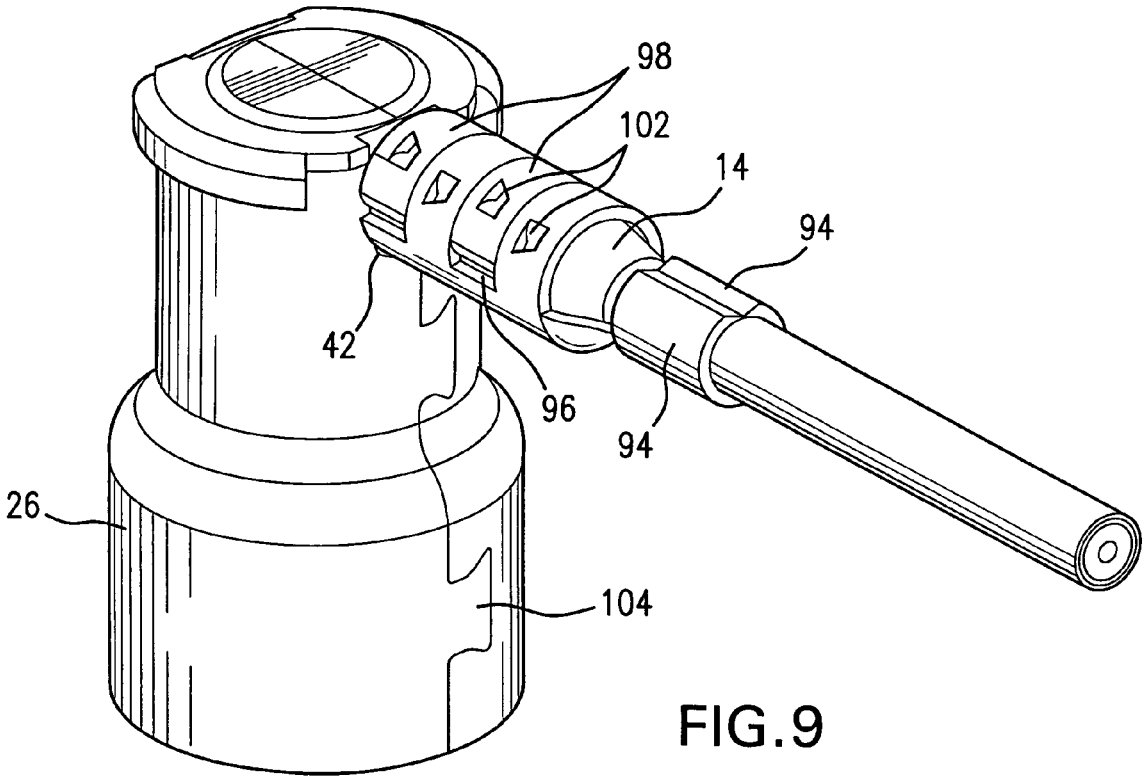
FIG. 9 is a perspective view of the connector and secured cable end.

The outer female socket or contact 50 according to the present invention has a partially tubular or cradle-like extension or ferrule 86 extending at a right angle from the ring element 72 at an end 88 opposite the mating end 76. Again, the angle could be different than ninety degrees depending on the connector environment requirements. The ferrule 86 has a first end 90 integral with the ring element 72 and a second, free end 92 distal from the ring element. The second end 92 is formed into wire crimp tabs 94. The ferrule has two longitudinal edges 96 between the end 90 and the crimp tabs 94. Fingers or appendages 98 angle outward from the ferrule edges, initially in a v-shape. Four appendages (as best seen in FIGS. 1, 4 and 5) are illustrated, but there could be more or less. Cuts 100 in the fingers are used to create multiple serrations 102 facing each other across the width of the ferrule.

In the coaxial cable termination process made possible by the present invention, the inner contact terminal 48 is inserted into the dielectric member 52 in a pre-set position illustrated by FIG. 2. The dielectric member is inserted and held in place within the outer contact 50. The terminal device 46 is then received in one piece of the connector housing 24. Another piece of the connector housing is then assembled around the outer contact 50. One possible way of doing this is illustrated in FIG. 5. The main section 26 of the housing 24 is split essentially in half with interlocking features 104. The barrel section 36 would also be split into partially tubular sections, as suggested by the barrel cross-section 106 as viewed in FIG. 2. The housing halves could be reliably secured together around the terminal device 46 by adhesive, for example, or other suitable means. The ferrule 86 would extend through the housing aperture 42 under and partially or part-way around the barrel section 36. The crimp tabs 94 would project beyond or be spaced from the barrel section.

Figure 3:
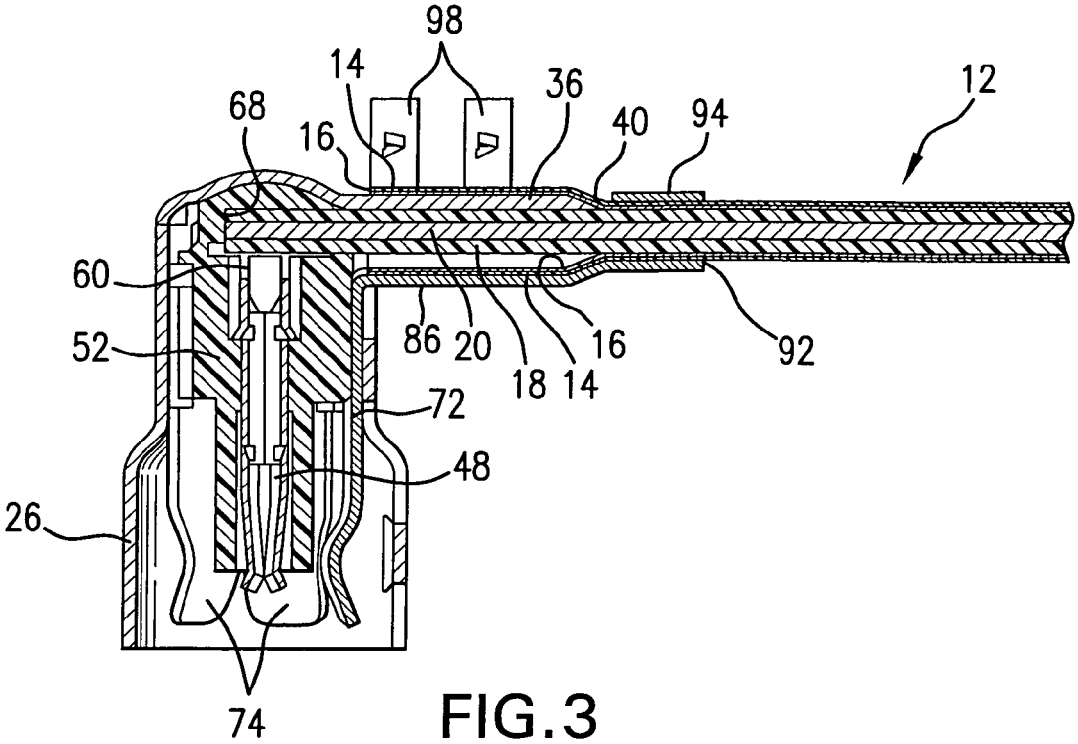
FIG. 3 is a cross-sectional side view similar to FIG. 2 but with the cable end inserted into the connector.

The insulation layer 18 and conductive core 20 of the stripped cable end 22 is then inserted into the barrel section 36 of the housing 24, as best illustrated in FIGS. 3 and 4. The sharp-edged end 40 of the barrel section slides between the conductive braid 16 and the inner insulation layer 18. The barrel section is substantially surrounded by the sheath 16 and outer cable jacket 14

FIGS. 6–9 illustrate the final assembly of cable and connector. The entire assembly process can be automated. The tabs 94 are crimped around the outer jacket 14 of the cable to improve the reliability of the connection. The appendages 98 are wrapped or crimped around the jacket and sheath 16 enclosing the barrel section 36. The appendages inter-fit and interlock, forming a substantially complete tube around the outer jacket, sheath and barrel section. The serrations 102 cut through the outer jacket and contact the sheath. The outer contact 50 is thereby directly electrically connected to the conductive braid or sheath 16 of the cable. Finally, the inner center contact terminal 48 is pressed or forced further into the dielectric member 52 to an engaged position wherein the insulation displacement blades 60 cut through the inner insulation layer 18 and electrically connect the cable core 20 with the terminal 48.

The completed assembly is received in a plastic, electrically non-conductive housing (not shown). The ferrule 86 and outer contact 50 act as electrical grounds and shields for the inner terminal 48 and the terminated end 22 of the cable.

The crimp ferrule fingers or appendages 98 and serrations 102 illustrated and described could be replaced with other structure performing the same function. Substitutes, for example, could include: traditional insulation displacement blades; shears formed in the appendages and ferrule to provide teeth-like features; widely spaced fingers that when crimped penetrate the jacket material, the spaces in between the fingers allowing the excess jacket material to move; raised ridges in the ferrule that penetrate through the jacket when crimped; or a wire spiral wrapped under high tension and then spot-welded in place. The assembly process could be rearranged to electrically connect the terminal 48 with the cable core 20 prior to crimping of the appendages and tabs (in whatever order or simultaneously), depending on the reliability of the separate component retaining features.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. A connector for a coaxial cable, the cable having a conductive core, a conductive sheath separated from the core by an inner insulating layer, and an insulating outer jacket surrounding the conductive sheath, the connector comprising:

a housing;

a barrel section extending from the housing, the barrel section configured to slide between the inner insulating layer and the conductive sheath of the cable;

an aperture in the housing partially surrounding the barrel section where the barrel section extends from the housing;

a dielectric member mounted in the housing;

an inner electrical terminal secured within the dielectric member and arranged for attachment to the core of the cable;

an outer electrical contact positioned in the housing between the dielectric member and housing, the outer electrical contact including a portion extending out of the housing through the aperture and part-way around the barrel section, the portion including at least one appendage for wrapping around the outer jacket and sheath of the cable and the barrel section, the outer electrical contact having an end for receiving a mating connector; and means on the at least one appendage for penetrating the outer jacket to electrically contact the conductive sheath inside the outer jacket at a location where the outer jacket and conductive sheath surround the barrel section.

2. The connector of claim 1 wherein the portion of the outer electrical contact extends out of the housing at a right angle.

3. The connector of claim 1 wherein the means for penetrating the outer jacket to contact the conductive sheath comprises at least one serration on the at least one appendage.

4. The connector of claim 3 wherein there are multiple appendages spaced apart along a length of the portion of the outer electrical contact and serrations on each appendage.

5. The connector of claim 1 wherein the portion of the outer electrical contact extending out of the housing has a partially tubular shape for extending part-way around the barrel section.

6. The connector of claim 5 wherein the portion of the outer electrical contact extending out of the housing has a free end distal from the housing, the free end, having tabs for crimping around the outer jacket of the cable in a location spaced from the barrel section.

7. The connector of claim 6 wherein the at least one appendage extends from an edge of the partially tubular shape between the housing and free end.

8. The connector of claim 7 wherein there are multiple appendages, each appendage extending from an edge of the partially tubular shape.

9. The connector of claim 8 wherein the appendages on each edge are spaced apart along a length of the portion of the outer electrical contact and sized such that they interlock to form a substantially complete tube with the partially tubular shape when the appendages are crimped around the outer jacket, conductive sheath and barrel section.

10. The connector of claim 9 wherein each appendage has means for penetrating the outer jacket and contacting the conductive sheath.

11. The connector of claim 10 wherein the barrel section is configured to prevent penetration of the penetrating and contacting means into the inner insulating layer of the cable.

12. A connector for a coaxial cable, the cable having a conductive core, a conductive sheath separated from the core by an inner insulating layer, and an insulating outer jacket surrounding the conductive sheath, the connector comprising:

a terminal device having an inner terminal, an outer, concentric electrical contact having an end for receiving a mating connector, and a dielectric member sandwiched between the inner terminal and the outer electrical contact, the dielectric member electrically isolating the inner terminal and outer electrical contact from each other;

a housing having a first section positioned completely around the terminal device and a second section extending from the first section and sized and arranged to slide between the inner insulating layer and conductive sheath of the cable; and a ferrule joined to the outer electrical contact of the terminal device and extending from the outer electrical contact out of the first section of the housing, the ferrule having at least one appendage positioned to wrap around the outer jacket and conductive sheath of the cable and the second section of the housing, the at least one appendage having means for penetrating the outer jacket to contact the conductive sheath inside the outer jacket and electrically connect the conductive sheath with the outer electrical contact, the second section of the housing being positioned to protect the inner insulating layer and core of the cable from the penetrating means.

13. The connector of claim 12 wherein the inner terminal includes insulation displacement blades for cutting through the inner insulation layer of the cable to electrically connect the conductive core of the cable with the inner terminal within the housing.

14. The connector of claim 12 wherein the means for penetrating the outer jacket and electrically contacting the conductive sheath comprise at least one serration on an inner surface of the at least one appendage.

15. The connector of claim 12 wherein the ferrule is integral with the outer electrical contact.

16. The connector of claim 12 wherein the ferrule has multiple appendages, each appendage having penetrating means.

17. The connector of claim 16 wherein the multiple appendages angle outward from two longitudinal edges of the ferrule and are spaced apart along a length of the ferrule and sized such that the appendages interlock and form a complete tube when wrapped around the outer jacket, conductive sheath and second section.

18. A connector for a coaxial cable, the cable having a conductive core, a conductive sheath separated from the core by an inner insulating layer, and an insulating outer jacket surrounding the conductive sheath, the connector comprising:

a housing having a main section;

a barrel section extending from the main section of the housing at a right angle, the barrel section sized and configured to slide between the inner insulating layer and the conductive sheath of the cable;

an aperture in the main section of the housing partially surrounding the barrel section;

a dielectric member mounted in the main section of the housing;

an inner electrical terminal secured within the dielectric member and arranged for attachment to the core of the cable;

an outer electrical contact positioned between the dielectric member and main section of the housing, the outer electrical contact having an end for receiving a mating connector, the outer electrical contact further having an element for receiving the dielectric member and a portion extending out of the housing aperture at a right angle from the element and adjacent to the barrel section, the portion including at least one appendage positioned to wrap around the outer jacket and conductive sheath of the cable and the barrel section; and means on the at least one appendage for penetrating the outer jacket to electrically contact the conductive sheath inside the outer jacket at a location where the outer jacket and conductive sheath surround the barrel section.

* * * * *